United States Patent [19]

Hammond

[11] Patent Number: 4,869,034

[45] Date of Patent: Sep. 26, 1989

[54] SECTIONAL CIRCULAR STAIRCASE

[76] Inventor: Robert S. Hammond, 17251 Jefferson Hwy., Baton Rouge, La. 70817

[21] Appl. No.: 267,837

[22] Filed: Nov. 7, 1988

[51] Int. Cl.[4] ..... E04F 11/18

[52] U.S. Cl. ..... 52/184; 52/187; 52/227

[58] Field of Search ..... 52/182–191, 52/223 R, 227, 225

[56] References Cited

U.S. PATENT DOCUMENTS

| | | | |
|---|---|---|---|
| 2,471,352 | 5/1949 | Safir | 52/191 |
| 3,021,928 | 2/1962 | Blair | 52/191 |
| 3,418,770 | 12/1968 | Allmand | 52/187 |

FOREIGN PATENT DOCUMENTS

| | | | |
|---|---|---|---|
| 224523 | 10/1959 | Australia | 52/191 |
| 10482 | 10/1956 | Fed. Rep. of Germany | 52/187 |
| 1533333 | 6/1968 | France | 52/187 |
| 1519768 | 8/1978 | United Kingdom | 52/187 |

OTHER PUBLICATIONS

Dictionarre Construction ©1881 by Pierre Chabat, pp. 381–382.

*Primary Examiner*—Richard E. Chilcot, Jr.
*Attorney, Agent, or Firm*—Timothy J. Monahan; William David Kiesel; Robert C. Tucker

[57] ABSTRACT

A circular staircase in which each of the inside and outside stringers are constructed from a plurality of blocks strung together with cables. The blocks are substantially parallogram shaped with vertical ends which are bevelled to the inside. The blocks are strung end to end on tensioned cables. Shear pins inserted at the junction between adjacent blocks prevent relative vertical displacement between blocks. Spaced, horizontal treads join the inside and outside stringers together.

1 Claim, 3 Drawing Sheets

SECTIONAL CIRCULAR STAIRCASE

BACKGROUND OF THE INVENTION

1. Field of the Invention

This invention relates generally to circular staircases and particularly to a circular staircase having inside and outside stringers constructed from a plurality of parallelogram shaped blocks connected end to end.

2. Prior Art

A circular staircase has three main components, an inside and outside stringer and the treads. Typically, a stringer extends from a first floor to a second floor through an angle of about 90°. The radius of the curve of a stringer may vary. In the simplest example, both the inside and outside stringers curve along constant radii and the tread length is also constant throughout the staircases. Handrails, supported by balusters extending upward from each stringer, complete the staircase.

The greatest expense of making a circular staircase, both in labor and materials, is constructing the stringers. One prior art method of building a stringer is to bend a board around a large cylindrical form. Additional layers of boards are glued on to create a curved, laminated beam representing a portion of a helix. Right angle cylindrical forms are used to produce a stringer, which when installed, will have side edges perpendicular to the floor. Standard sized stringers are available from staircase manufacturers. However, deviations from the standard sizes require custom built stringers, further increasing the expense of the staircase. Another shortcoming of the prior art methods of construction is that the stringers are expensive to ship owing to their large size and awkward configuration. Even when the stringers are constructed on-site, the necessary cylindrical forms must be available at the site.

A modular design for spiral staircase, rather than circular staircase, construction is shown in Hughes, Jr., U.S. Pat. No. 3,491,498. In Hughs, Jr., the treads are sandwiched between column sections. The column sections are truncated parallel to the floor with the axis of each section being slanted in relation to the floor.

However, the technology developed by Hughes for a spiral staircase is not readily applied to a circular staircase for several reasons. A supporting columnn of a spiral staircase turns with a tight radius through an angle of about 270° with an upward slope of about 55°. Given the steep slope of the column of spiral staircase, a force normal to a tread will exert significant compressional force on the column and will have much smaller component exerting torque on the individual column sections. Conversely, the stringers of a circular staircase turn with a much larger radius through an angle of about 90°. The upward slope of an outside stringer is typically 31°. It can be readily seen that a force acting normal to a tread in a circular staircase will exert significantly greater torque on the individual segments. If segments with horizontal ends are used to construct the circular staircase, much greater strain would be put on the tensioning cables as the slope of the supporting columns decreases. Most building codes require that a circular staircase be able to support 100 pounds per square foot.

Traditional circular staircase stringers have the shape of a curved beam with approximately a 13" height. The sides of a stringer are perpendicular to the floor. Hughes method, which employs segments with horizontal ends, when applied to a beam shaped stringer, would produce a discontinuous jagged surface. For example if one segment is used per tread, each segment must be rotated approximately 7° from the adjoining segment. If a parallelogram sided segment is turned 7° in a horizontal plane, the horizontal ends would not align. The less the slope of the stringer, the longer the horizontal ends and the greater the effect the rotation would have on alignment. Therefore, not only are there stability problems associated with building a circular staircase with the method disclosed in Hughes, U.S. Pat. No. 3,491,498, but the resuld would not simulate the aesthetically pleasing features of a traditional circular staircase.

SUMMARY OF THE INVENTION

Therefore, an object of the invention is to provide a quicker, less expensive method of constructing a circular staircase.

Another object of the invention is to provide a circular staircase which can be shipped disassembled and constructed relatively easily at a job site.

Another object of the invention is to provide a circular staircase which can be readily modified to accommodate various heights.

Still another object of this invention is to provide a circular staircase with stringers made up of a plurality of blocks.

Yet another object of this invention is to provide a circular staircase with segments with simulate traditional circular staircase designs.

Accordingly, a circular staircase is provided having curved inside and outside stringers supporting a plurality of spaced horizontal treads. Each of the stringers is constructed from a plurality of blocks having vertical, bevelled ends in diagonal relationship. The blocks are placed end to end and held in place by construction cables threaded through the blocks. Dowels through the ends of adjacent blocks prevent shearing.

PREFERRED EMBODIMENT OF THE INVENTION

Without limiting the scope of the invention, the preferred features of the invention are set forth below.

Figure 1:
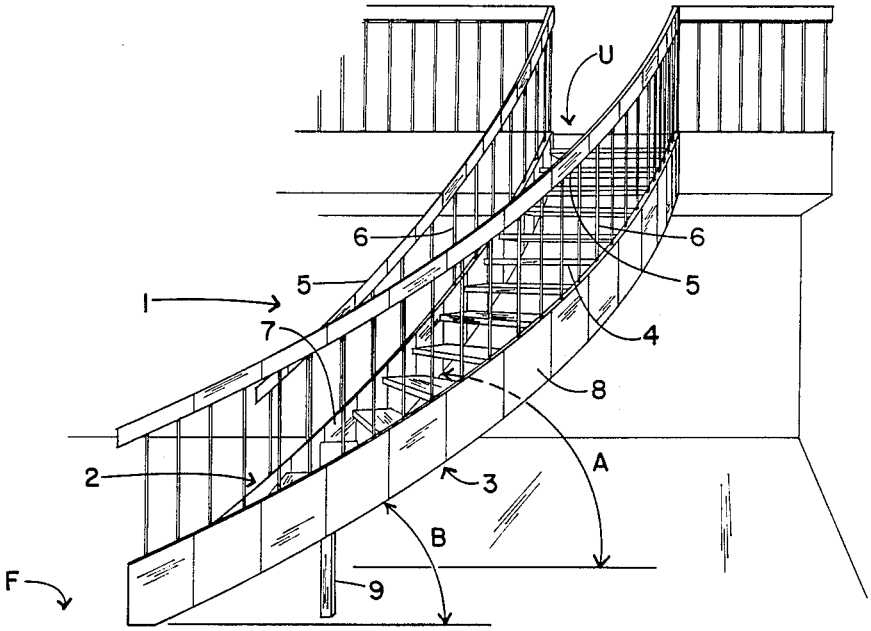
FIG. 1 is a perspective of the circular staircase.

FIG. 1 is a perspective view of the assembled circular staircase which has been generally designated staircase 1. The backbone of staircase 1 is made up of inside stringer 2 ascending at angle A, outside stringer 3 ascending at angle B and treads 4 connected at each of their ends to the stringers. A railing is also provided with banister 5 connected to balusters 6 which extend upward from the top of stringers 2 and 3. Inside stringer 2 is made up of a plurality of blocks 7 which are joined together end to end. Likewise, outside stringer 3 is made up of a plurality of blocks 8 joined together end to end, outside blocks 8 being somewhat wider than inside blocks 7. A detailed description of the blocks is provided below.

As shown in FIG. 1, staircase 1 is engineered to be free standing. The only points of attachment are to the floor F at the bottom of staircase 1 and to an upper floor U at the top of staircase 1. Brace 9 may be provided for support without obstructing traffic around staircase 1.

Figure 2:
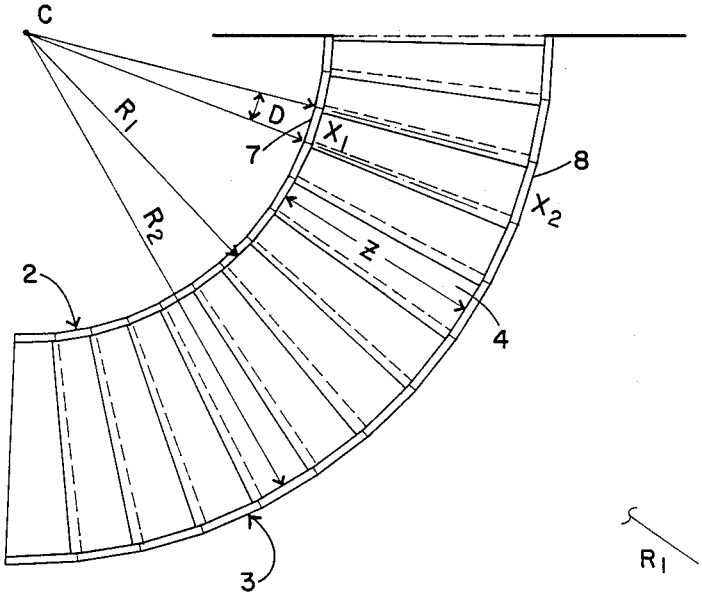
FIG. 2 is plan view of the circular staircase.

Referring to FIG. 2, a top view of staircase 1 shows a typical layout. Inside stringer 2 has radius $R_1$ from centerpoint C. Outside stringer 3 has radius $R_2$ from the same common centerpoint C. Each of blocks 7 and blocks 8 match one of treads 4. The angle encompassed by each of blocks 7 and 8 has been designated D and, in the preferred embodiment, remains constant. Of course, the width of block 7, designated $X_1$, is smaller than that the width of block 8, designated $X_2$. The width of $X_1$ and $X_2$ is proportional to $R_1$ and $R_2$ and can be represented by the following formula:

$$\frac{X_1}{X_2} \quad \frac{R_1}{R_2}$$

The vertical rise per block of each of inside blocks 7 is the same as that of outside blocks 8, keeping treads 4 level. Therefore, the slope of each stringer, the vertical rise over the horizontal run, the tangent of angle A and the tangent of angle B for inside stringer 2 and outside stringer 3 respectively, can be related to $R_1$ and $R_2$ by the following formula:

$$\frac{\tan A}{\tan B} \quad \frac{R_2}{R_1}$$

Typically, angle D is approximately 7° and between 12 to 17 treads are provided. Standard treads lengths, designated Z in FIG. 2, are 42" and 48". Table 1 below lists some of the other design parameters typically employed with a 7½" rise per tread.

| Tread Length | $R_1$ | $R_2$ | A | B | $X_1$ | $X_2$ |
|---|---|---|---|---|---|---|
| 42" | 60" | 104" | 45.4 | 31.1 | 7.3" | 12.5" |
| 48" | 60" | 110" | 45.4 | 28.4 | 7.3" | 13.4" |

The construction techniques comprising the invention herein are applicable to a wide variety of stairway configurations. With regard to circular staircases, angle A of the inside stringer is preferably in the range of 35° to 50°, and angle B of the outside stringer is preferably in the range of 21° to 35°. While circular staircases are typically constructed within the aforementioned ranges, those with skill in the art may adapt the teachings herein to staircases outside the ranges without deviating from the invention herein.

Figure 3:
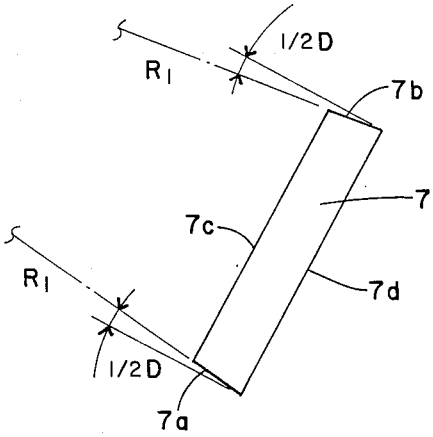
FIG. 3 is a top view of a block comprising an inside stringer of the circular staircase.

Referring to FIG. 3, an enlarged overhead view of one of inside blocks 7 is shown. Block 7 has two beveled ends *7a* and *7b* which are vertical. Each of said ends are bevelled to the inside face, *7c*, at an angle of ½ D, where D is the degrees of turn per block, and in the case of the preferred embodiment, degrees per tread. When adjacent blocks 7 are joined end to end, each having a bevelled end of ½ D degrees, the result is a turn of D degrees per tread. Adjacent blocks 7 form an obtuse angle of 180°-D. The degree of bevelling at each end of block 7 can be represented as (180°-obtuse angle)×½. Those with skill in the art will recognize that in the foregoing example the joined ends of adjacent blocks need not be equally bevelled and in fact one end could be bevelled D degrees and the other end could be at right angles to the inside face *7c*. However, it is preferred that ends of adjacent blocks have maximum surface contact, i.e. that the ends be equally bevelled, both for structural integrity and to create an aesthetically pleasing trace. The inside and outside faces, *7c* and *7d* respectively, of blocks 7 are also vertical. It is important that each of the ends, *7a* and *7b*, are bevelled in a vertical plane. Otherwise, the faces of the stringer will twist out of the vertical plane when blocks 7 are joined together.

Figure 4:
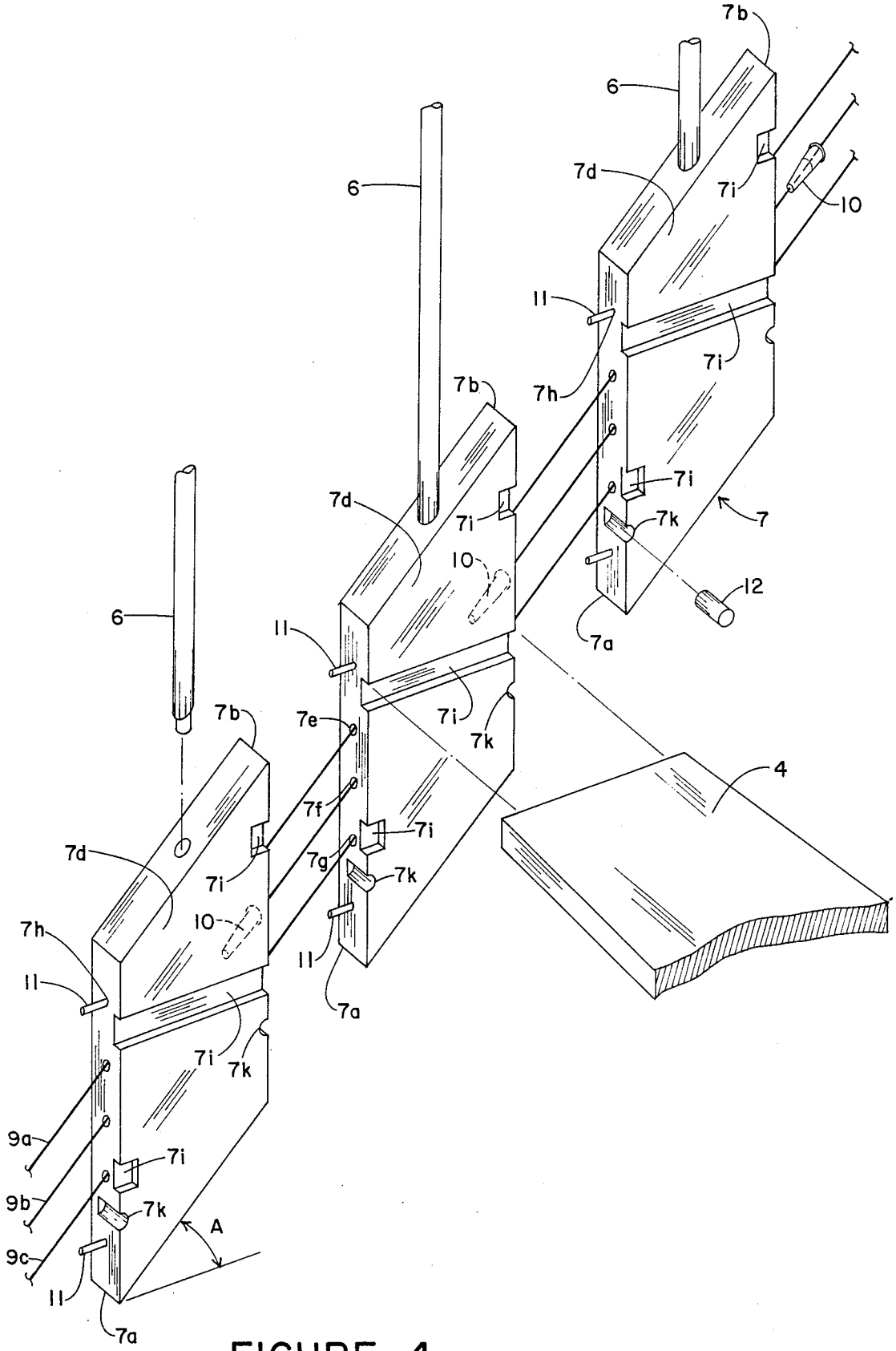
FIG. 4 is an exploded view of a portion of the inside stringer.
Figure 5:
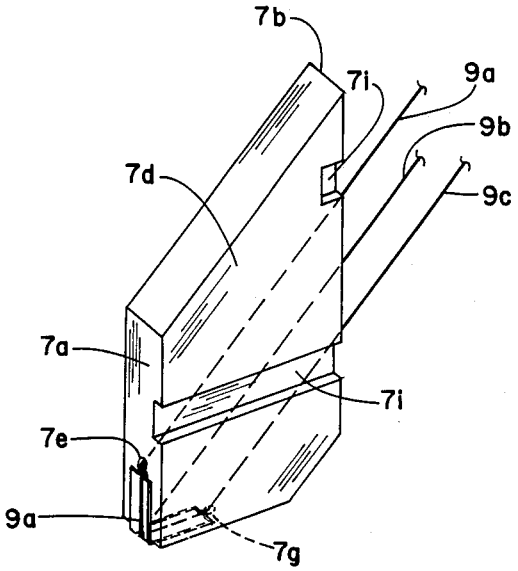
FIG. 5 is a perspective of the lower end block of a stringer.

FIG. 4 is an exploded view of a portionof inside stringer 2. Blocks 7 are joined together by three construction cables, *9a*, *9b* and *9c* which are threaded through channels *7e*, *7f* and *7g* in each of blocks 7. Cables 9 are ¼" diameter construction cables which are tensioned to approximately 4,000 pounds each. In a preferred embodiment shown in FIG. 5, cables *9a* and *9c* form a continuous loop around the bottom block of each stringer. Referring back to FIG. 4, at the upper end, *7b*, of each block 7, a cable gripper 10 is inserted in a recess in end *7b* around channel *7f*. Cable gripper 10 allows cable *9b* to be drawn through from end *7a* to *7b* of each of blocks 7 without allowing cable *9b* to be drawn back in the opposite direction. Cable grippers 10 facilitate construction because one need not wait until the entire stringer is assembled to secure the blocks together. An alternative to using cables would be to run a threaded through the blocks and bolt the blocks together.

Significant shear forces are encountered at the junction of adjacent blocks 7. To maintain alignment of blocks 7 and counteract the shear forces, dowels 11 are inserted in holes *7h* drilled in each of ends *7a* and *7b*. In a preferred embodiment, dowels 11 are made of steel.

Blocks 7 are also provided with horizontal notches *7i* for treads 4. The end of tread 4 which is inserted into notch *7i* is slightly wider than face *7d* of an individual block. Notch *7i* continues on to adjacent blocks to accommodate the extra tread width. The overlap to tread 4 to adjacent blocks 7 also provides reinforcement against shear forces by interlocking blocks 7.

Another feature employed to counteract shear forces between blocks is to insert shear pins 12 into grooves *7k* in each of ends *7a* and *7b* of blocks 7. Grooves *7k* may be made by drilling a hole at the junction between adjacent blocks after the stringer has been assembled.

The opposite end of tread 4 is inserted into a similar notch in block 8 outside stringer 3 (not shown). Of course tread 8 is wider at its opposite end to accommodate the greater width of blocks 8. Except for the greater width of blocks 8 and the fact that thread 4 connects to the inside face rather than outside face as is the case with blocks 7, blocks 8 are assembled in the same fashion as blocks 7. An additional difference is that a single baluster 6 is inserted into each of blocks 7 while two balusters are inserted into each of blocks 8 in outside stringer 3.

The ends of blocks 7 and blocks 8 are in diagonal relation to one another representing the slope of the particular stringer. From the side, each of the blocks define a parallelogram as shown in FIG. 4. However, the stringers may be modified to present an open or stepped side view as discussed below.

Figure 6:
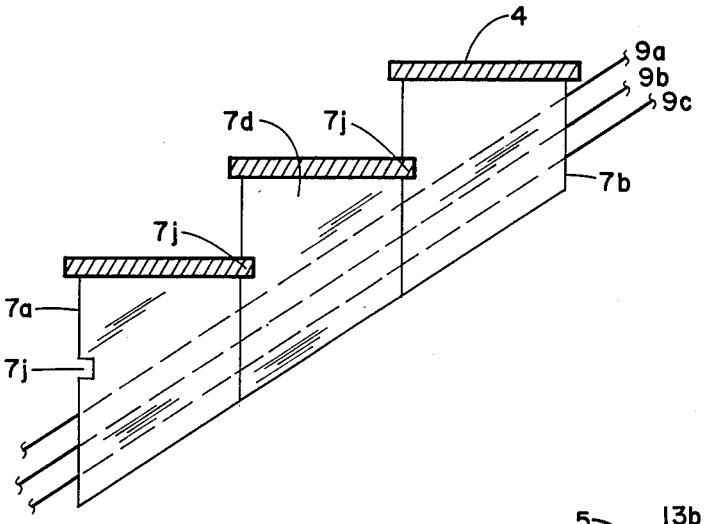
FIG. 6 is a side view of a stringer embodying an open design.

In FIGS. 1 and 4, staircase 1 is illustrated with a closed stringer design. The invention herein may be readily adapted to the open or stepped stringer design as shown in FIG. 6. The main difference between the open and closed designs is the placement of treads 4. In the open design, FIG. 6, notches *7j* are only provided in the lower end, *7a*, of each block 7. Each of treads 4 interlock two blocks only.

Figure 7:
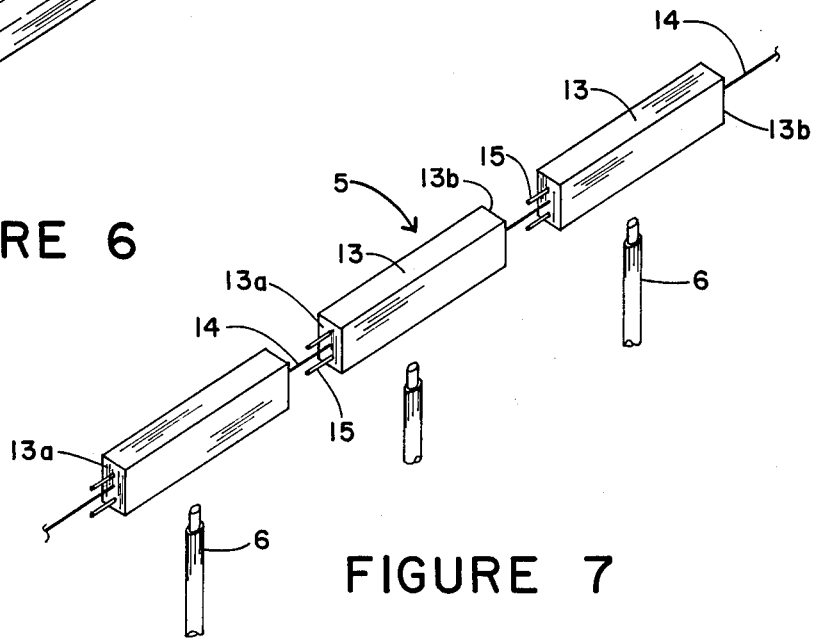
FIG. 7 is an exploded view of a sectional banister.

FIG. 7 shows a preferred embodiment of banister 5. The same technique in constructing inside and outside stringers 2 and 3 is applied to the corresponding banister. Banister 5 is made up of rails 13 strung together on cable 14. Dowels 15 in ends 13*a* and 13*b* of rails 13 maintain alignment. The specifications of banister 5 correspond to those used in constructing the stringers especially with regard to bevelling the ends 13*a* and 13*b*. Banister 5 is supported by balusters 6 extending from the stringer below.

There are, of course, many alternate embodiments and modifications of the invention disclosed herein which are intended to be included within the scope of the following claims.

What I claim is:

1. A banister for a circular staircase comprising:

(a) a first linear rail having a vertical first end and a vertical second end in diagonal relationship to said first end;

(b) a second rail having a vertical first end flush against said second end of said first rail wherein said first rail and said second rail form an obtuse angle relative to a horizontal plane, said second rail further having a second end in diagonal relationship to said first end of said second rail;

(c) a third rail having a vertical first end flush against said second end of said second rail, wherein said second rail and said third rail form an obtuse angle relative to said horizontal plane, said third rail further having a vertical second end in diagonal relationship to said first end of said third rail; and (d) means to rigidly connect said first and second rails and said second and third rails comprising:

(i) a cable threaded diagonally, end to end, through said first, second and third rails;

(ii) means to maintain said cable under tension and force said rails together; and (iii) means to prevent shearing between abutting ends of said rails.

* * * * *